United States Patent [19]

Reich

[11] 4,095,413

[45] Jun. 20, 1978

[54] ELECTRONIC TIMEPIECE

[76] Inventor: Joachim Reich, Am Holzweg 21, D 8036 Herrsching (Ammersee), Germany

[21] Appl. No.: 678,187

[22] Filed: Apr. 19, 1976

[30] Foreign Application Priority Data

Nov. 17, 1975 Germany ..... 2551541

[51] Int. Cl.[2] ..... G04C 3/00; G04C 17/00; G04C 19/00

[52] U.S. Cl. ..... 58/50 R; 58/23 R; 58/127 R

[58] Field of Search ..... 58/50 R, 126 R, 126 A, 58/127 R, 128, 23 R

[56] References Cited

U.S. PATENT DOCUMENTS

| | | | |
|---|---|---|---|
| 3,456,152 | 7/1969 | Andersen | 58/50 R X |
| 3,540,209 | 11/1970 | Zatsky et al. | 58/50 R |
| 3,992,875 | 11/1976 | Kashio | 58/50 R |

*Primary Examiner*—Stanley J. Witkowski
*Attorney, Agent, or Firm*—Price, Heneveld, Huizenga & Cooper

[57] ABSTRACT

An electronic timepiece with a display device, with an oscillator as a time base, with a frequency divider, which steps down the frequency of the oscillator to the desired clock frequency, with counting means for counting the clock pulses, and with decoding circuits. The display is a matrix of electrodes positioned to define time marks and actuated by signals from the decoding circuits. The one set of electrodes of the time marks are lines and the other set of electrodes of the time marks are columns of a matrix-like arrangement and the product of the number of lines and the number of columns is equal to the number of the time marks employed. Upon driving the lines and the columns only one respective time mark responds. The lines are constructed as concentric rings and the columns of the matrix-like arrangement are constructed as ring sections concentric to them. The rings and the ring sections together with the connections, arranged concentrically with respect to them, for one respective electrode of the time marks are printed on an insulating carrier and the rings with the corresponding connections for the time marks are connected over the other rings and insulated from them.

12 Claims, 13 Drawing Figures

ELECTRONIC TIMEPIECE

BACKGROUND OF THE INVENTION

1. Field to which invention relates

The invention relates to an electronic timepiece.

2. The prior art

Such an electronic timepiece is described generally in the German Patent Specification (Auslegeschrift) 1,548,081 and the German Patent Specification (Offenlegungschrift) 1,937,868.

SUMMARY OF THE INVENTION

One aim of the invention is that of developing such an electronic timepiece, which is only to be found in the prior art in its basic concept and theoretical construction, so that it can be produced in a simple and cheap manner making use of integrated circuits in accordance with known technologies and offered by producers.

In accordance with the basic principle of the invention this aim is achieved in accordance with the invention in that the lines of the matrix-like arrangement are constructed as concentric rings and the columns of the matrix-like arrangement are constructed as ring sections concentric to them. The the rings and the ring sections together with the connections are arranged concentrically. One respective electrode of the time marks are printed on an insulating carrier and the rings with the corresponding connections for the time marks are connected over the other rings and insulated from these other rings.

The construction of such an electronic timepiece becomes particularly advantageous if in accordance with a further development of the invention the circuit printed on the insulating carrier is covered with an insulating layer, which has access openings to the rings at the corresponding positions for the connection of the rings with the connections for the time marks and which leaves uncovered the ring sections and the connections. Furthermore, the conducting tracks which connect the rings with the corresponding connections for the time marks are printed on the insulating layer.

It will be seen that with such an arrangement it is possible to take as a point of departure an insulating carrier, to apply to this carrier the ring-like arrangement of rings, ring sections and connections, to cover this arrangement with an insulating layer consisting for example of silicon dioxide, a fused glass or the like. Corresponding access openings and free positions are then produced or in the course of the application of this insulating layer can be left free by suitable masking. The production of the corresponding access openings and the parts which are to remain uncovered can for example be carried out by removal of material by etching. Since these measures are very simple and are familiar to producers of printed circuits, the arrangement in accordance with the invention provides the possibility of using these well known and simple methods in the case of the construction of the electronic timepiece.

It is particularly advantageous if in accordance with a further development of the invention on the insulating carrier in the free central part of the ring and ring section arrangement connections or terminals are printed. These on the one hand, are connected with the corresponding rings and ring sections and, on the other hand, serve for the connection to the integrated circuit. The intergrated circuit includes the oscillator, the divider stages, the counters and the decoding means. With this arrangement it is possible to arrange the integrated circuit in a particularly simple manner, for example with the help of the so-called flip-chip technology on the printed positions of connection for the integrated circuit.

In accordance with a further development of the invention it is possible to advantageously use LED'S as time marks whereby the anodes are connected with the corresponding rings and the cathodes are connected with the corresponding ring sections.

In this respect in accordance with a further development of the invention for further simplifying and cheapening the arrangement it is possible to use a block of LED material which extends over a number of time marks corresponding to the number of rings. The block is metallized in sections on the surface mounted on the insulating carrier and at these sections it is respectively soldered for connection with the connections. On the side remote from this at those positions, at which the time marks are to appear, it has a respective grid-like metallization and these metallizations are connected together and with the ring section.

The grid-shaped metallizations of the time marks and the associated metallizations on the other side of the blocks are advantageously directed towards the center of the circular arrangement, because in this manner the time marks can be constructed as lines or like the hands of a clock.

The grid-like metallization which are connected together and which form the cathodes of the LED'S, can be connected with the ring sections by bonding. Since bonding makes hand operation necessary, it is however more convenient and also cheaper and simpler if in accordance with a further embodiment of the invention an insulating layer is placed over the completely equipped circuit. The conducting tracks are arranged over windows in the insulating layer to provide a conducting connection between the blocks and the ring sections.

By omitting the ring sections, the blocks also can be connected directly with the corresponding connections of the integrated circuit.

In order to give the electronic timepiece a pleasing appearance, in accordance with a further embodiment of the invention, the arrangement constructed on the insulating layer can be covered with a covering plate similar to the dial of a clock and consisting of opaque material which adjacent to the time marks is made at least transluscent.

In accordance with a further modified embodiment of the invention as a timepiece dial a suitably dimensioned liquid crystal cell can be employed. One surface of the liquid crystal cell, on the observer side carries transparent electrodes corresponding to the arrangement of the time marks or a time mark group, which are connected with the ring sections, while its surface remote from the observeris provided with substantially opaque elecrodes at the positions of the time marks.

In accordance with a further development of the invention it is convenient for the electrodes for excitation of the liquid crystal cell to be passed from the two surfaces over rings of rubber becoming conducting under pressure to the integrated circuit.

Finally, in accordance with a further development of the invention a light source can be arranged behind the liquid crystal cell.

List of the Several Views of the Drawings

Reference is now had to the accompanying drawings.

Figure 3A:
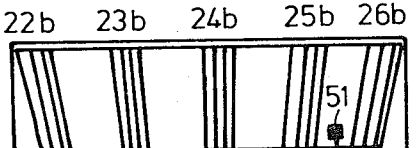
Figure 3B:
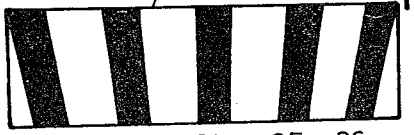
Figure 4A:
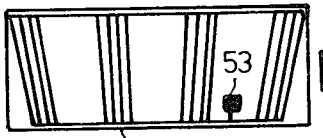
Figure 4B:
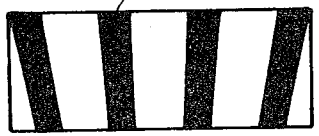

FIG. 3*a* shows the cathode side of the LED arrangement;

FIG. 3*b* shows the anode side of this LED arrangement;

FIG. 4*a* shows the cathode side of an LED arrangement for indicating the hours;

FIG. 4*b* shows the anode side of the LED arrangement in accordance with FIG. 4*a;*

Figure 5:
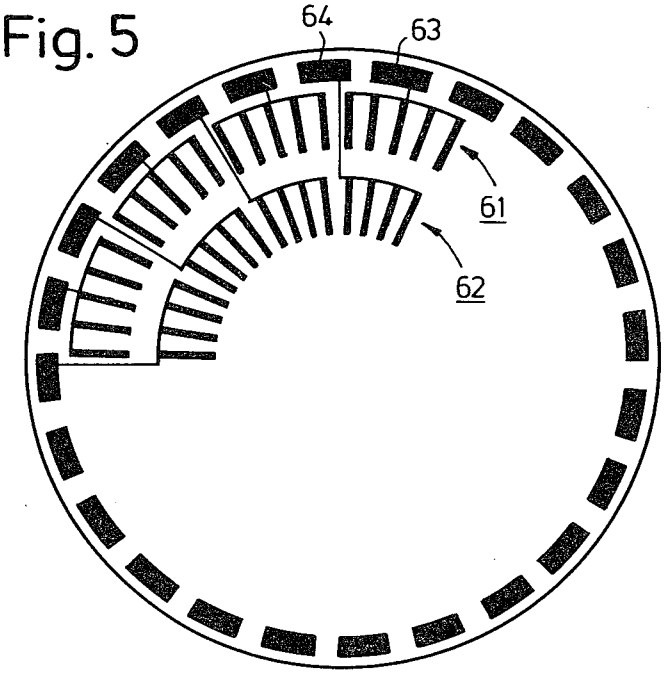
Figure 6:
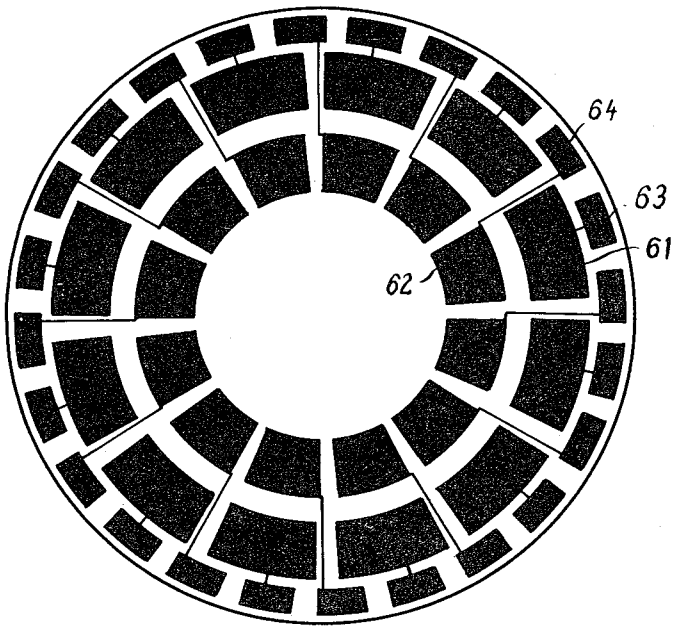
Figure 7:
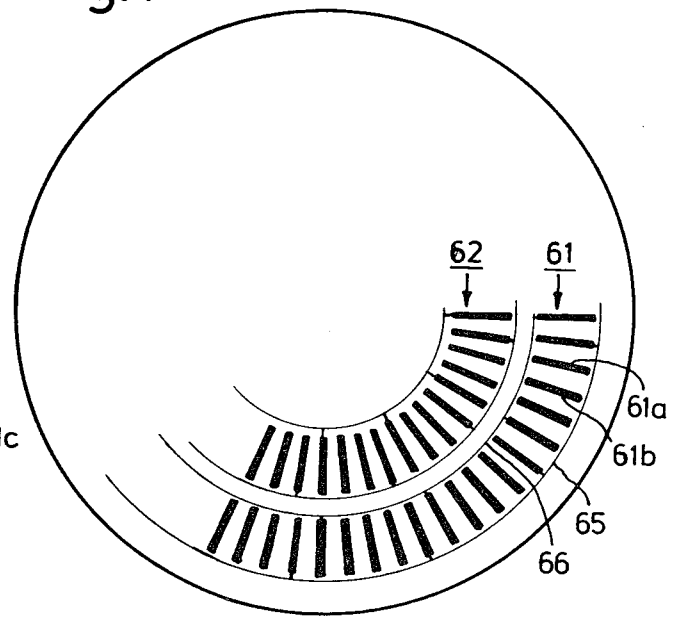
Figure 8:
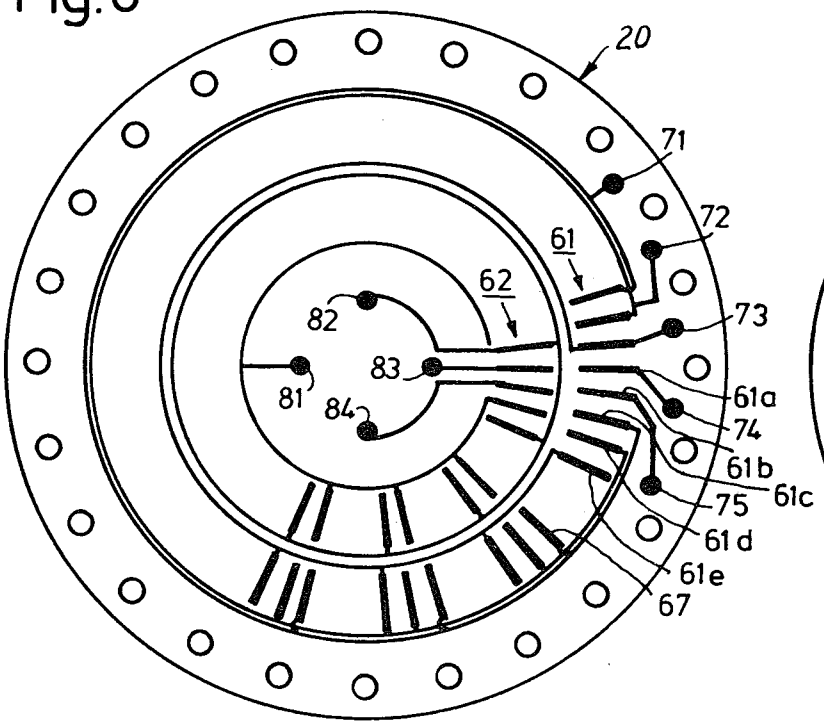
Figure 10:
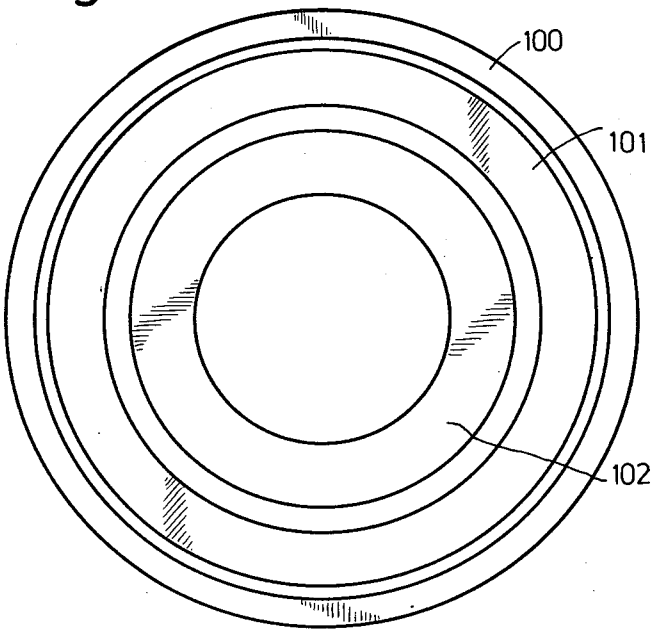
Figure 9:
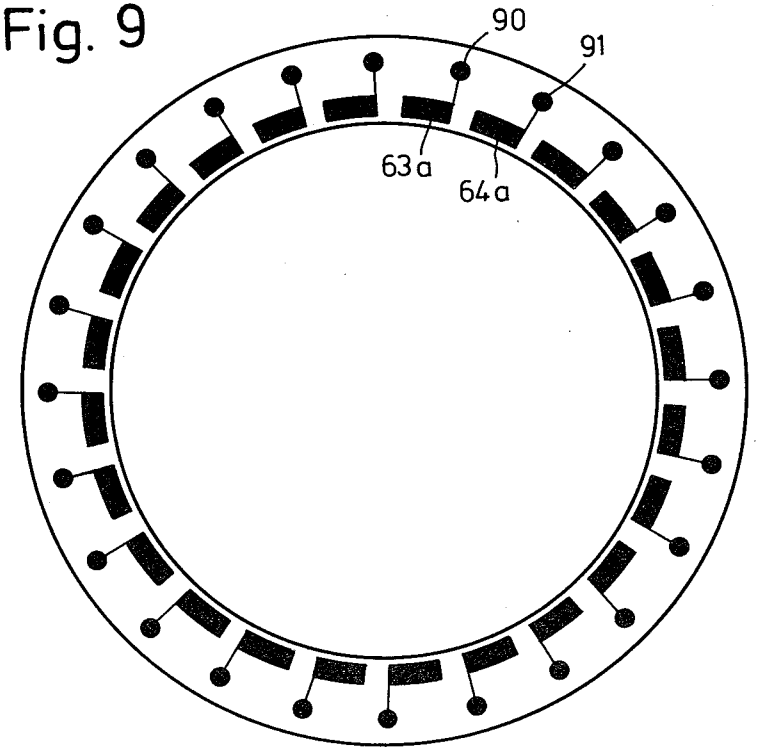

FIG. 5 shows the side, adjacent to the observer, of a liquid crystal cell forming a timepiece dial;

FIG. 6 shows a further embodiment of the side, adjacent to the observer, of a liquid crystal cell constructed as a timepiece dial;

FIG. 7 shows a ring of insulating material, which produces the contacts leading to the electrodes on the surface of the liquid crystal cell;

FIG. 8 shows the rings of rubber which become conducting under pressure, for making contact between the surfaces of the liquid crystal cell and the contact surfaces printed on the insulating material;

FIG. 9 shows the lower side of the liquid crystal cell;

FIG. 10 shows the base plate, producing the contacts; and

Figure 11:
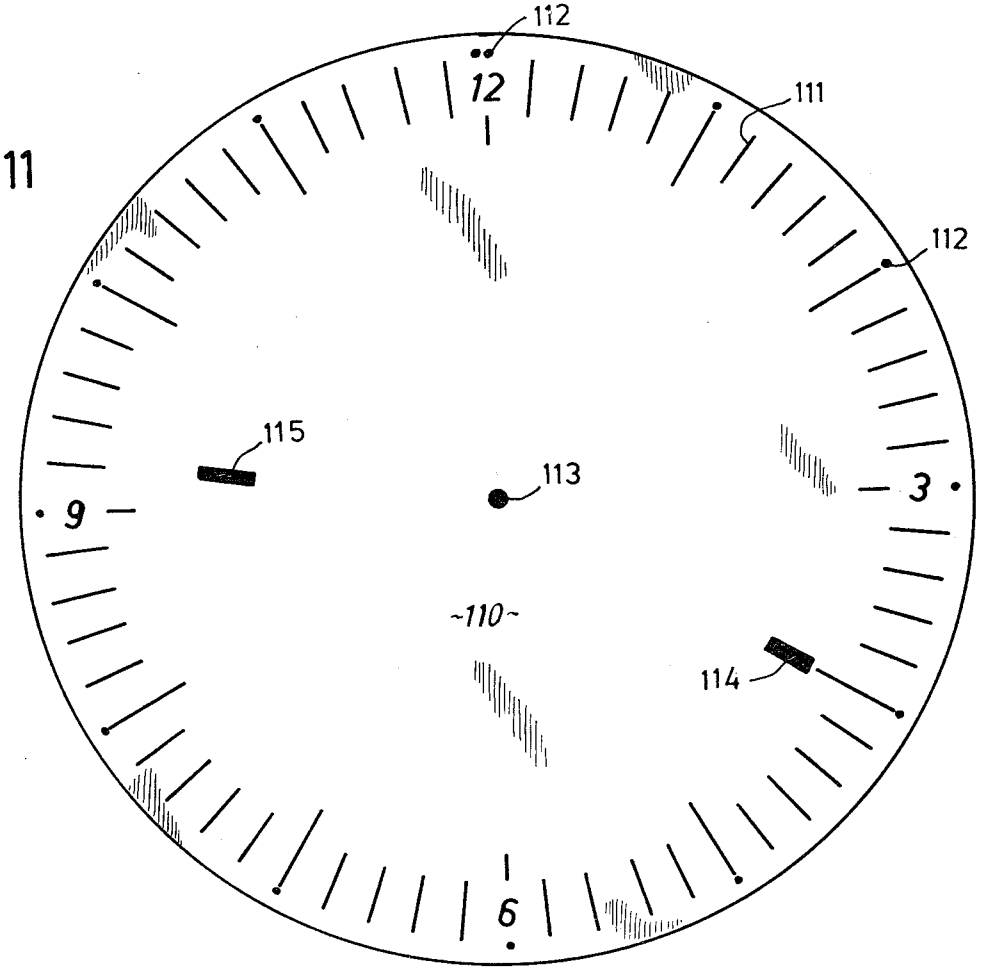

FIG. 11 shows a plan view of the timepiece dial.

DESCRIPTION OF THE PREFERRED EMBODIMENTS

Reference 1 denotes an arrangement of a quartz crystal and a regulating capacitor associated with it. This arrangement stabitizes the oscillator 2 at the resonance frequency of the quartz. The oscillator also includes a divider which steps down the frequency to a clock pulse frequency of 1/sec., so that at the output of the divider it is possible to provide display of a seconds clock pulse. A divider 3 is coupled to circuit 2 and provides at its output a clock pulse of 1/min., which is counted by the counter 4. This counter conveniently counts only from 1 to 5. At its outputs A, B, C, D the inputs A, B, C, D of a decoder 5 are connected, which decodes the conditions at the outputs of the counter. The outputs $A_1$ to $A_5$ of decoder 5, in the form of a voltage which for the sake of convenience is positive are applied to an arrangement 6, consisting of rings. The counter 4 provides at its output a clock pulse of 1/5 min. to a counter 7, which via a decoder 8 applies a voltage, now negative, to the ring sections 9. In accordance with the counting in the counter 4 five rings are provided and consequently there are 12 ring sections 9. In the drawing only the outputs K1 and K4 are shown as being connected with the ring sections 9, while the connections between the outputs K5 and K12 are omitted together with the corresponding ring sections 9 in order to simplify inspection of the drawing.

Since a satisfactory reading of the time is only possible, if there is a provision not only for indicating the full hours but also conveniently a corresponding time mark indicates all quarter hours, from the output pulses of counter 4 are fed to a further divider 10, at whose output correspondingly a clock pulse frequency of 1/15 min. is present. This output is connected to the input of a further counter 11, which via a decoder 12 connects a further group of four rings 13 with a voltage which is preferably positive. The output of the counter 11 signals with a clock frequency of 1/h (h being a time period of one hour) are fed to the counter 14, which via the decoder 15 then applies negative voltages to the further group of ring sections 16. The electrodes of the time marks indicated as diodes are connected respectively between one ring section and the corresponding ring. The counter 4 is caused to be operated with a clock pulse of 1/min. so that at the outputs of the counter 4 a signal corresponding to its count is produced, which is decoded by the decoder 5 and is then applied subsequently to the rings $6_A$, $6_B$, $6_C$, $6_D$, $6_E$. For the sake of example let it be assumed that simultaneously the first ring section 9A is switched on by the counter 7 acting via the decoder 8 so that the first diodes 17 in this ring section 9A are switched on one after the other at minute intervals. The counter 4 then jumps out of the position "5" back into the position "1" and in doing so provides a signal for the counter 7 so that the latter is switched on further and via the decoder 8 switches on the next ring section 9B, where the response of the time marks is repeated in the same manner from "1" to "5". Simultaneously however, the counter 4 on jumping back from "5" to "1" provides a signal to the divider 10, at whose output a signal is provided for the counter 11 after the counter 4 has performed three cycles, that is to say after 15 minutes. If, for example, the first ring section 16A and the first ring 13*a* were switched on, then after 15 minutes the second ring 13*b* is switched on so that the hour time mark appears advanced by one quarter of an hour. After one cycle of the counter 11, that is to say after the expiration of one hour, it feeds a signal to the counter 14, which via the decoder 15 switches on the next ring section 16B.

Figure 1:
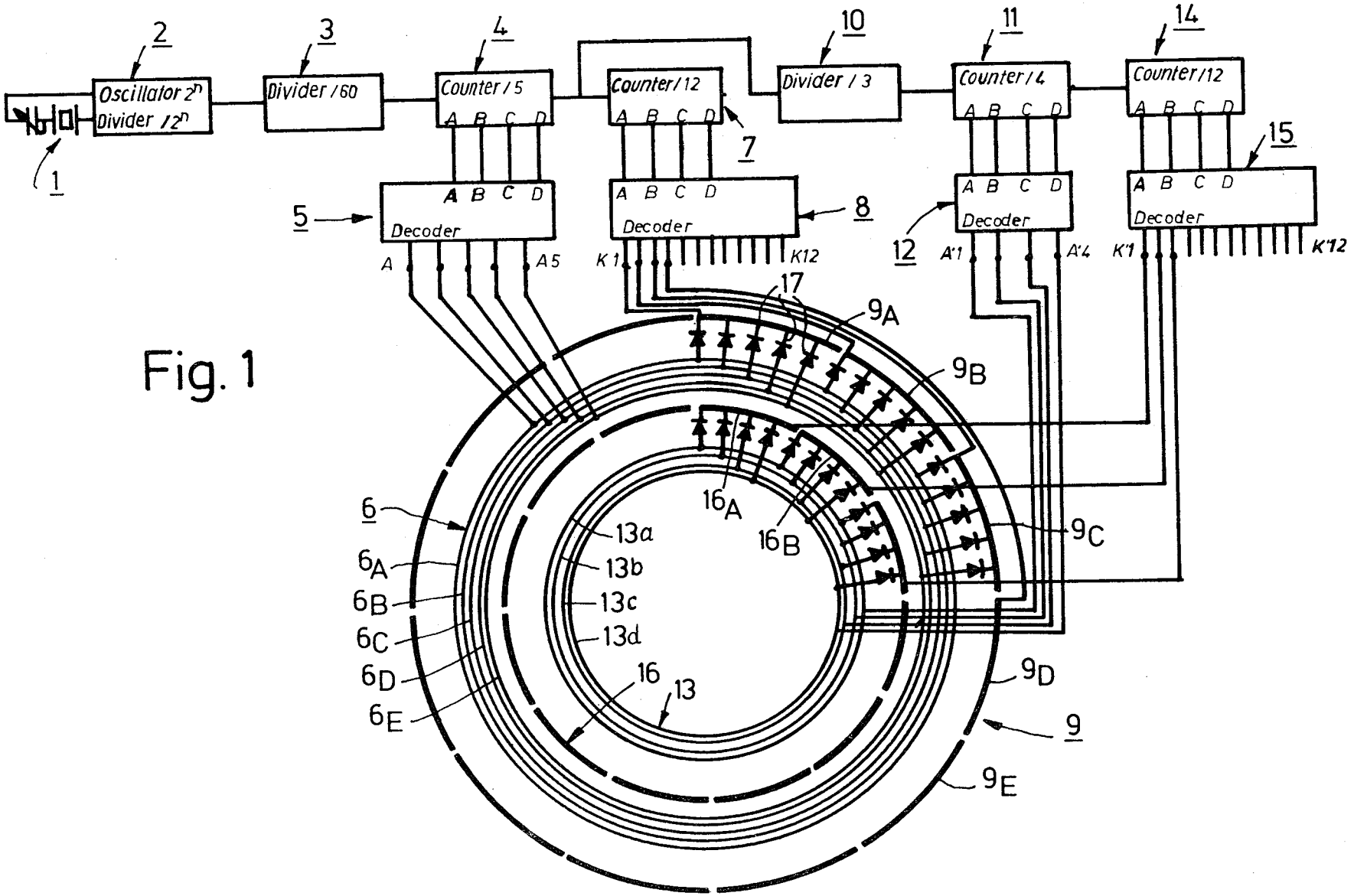
FIG. 1 shows a block circuit diagram of an electronic timepiece in accordance with the invention.
Figure 2:
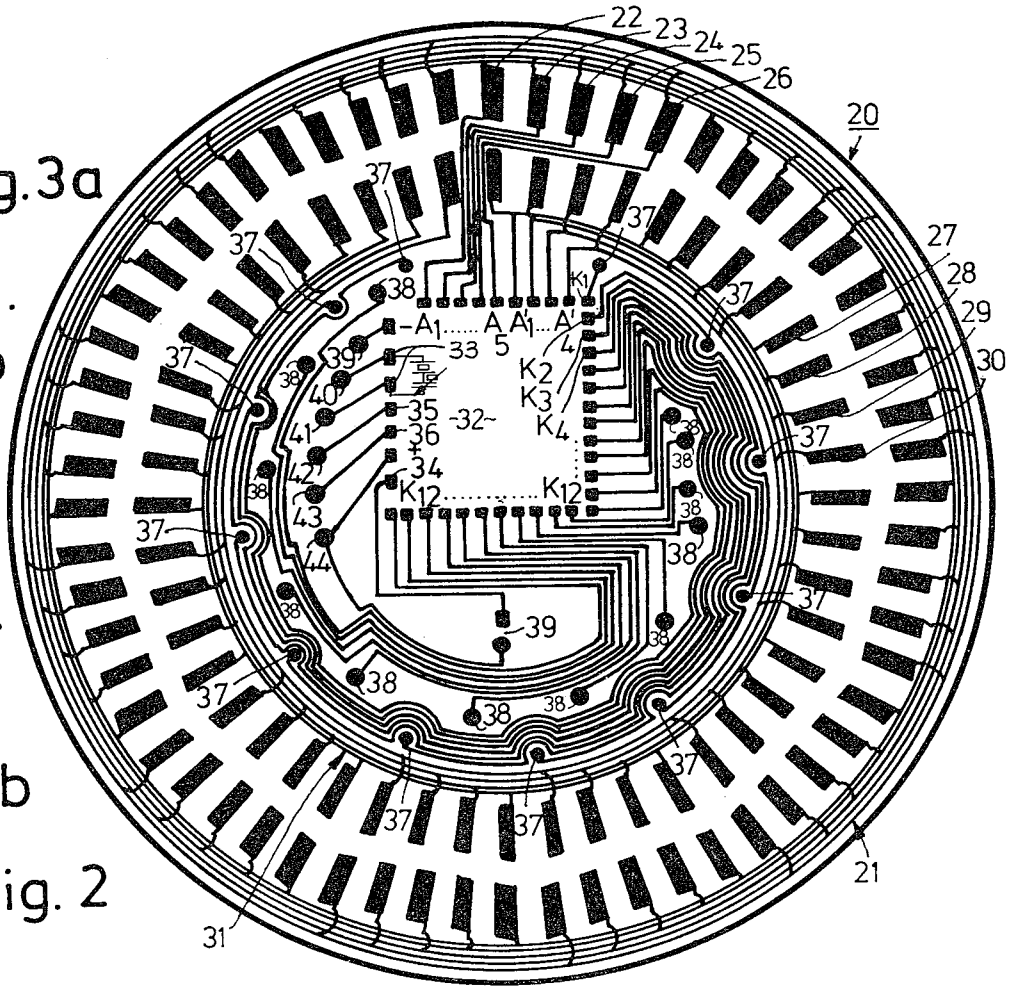
FIG. 2 shows the printing plan in accordance with the invention, with the electronic circuits omitted.

FIG. 2 shows the technically convenient construction of the ring and ring section arrangement, which was only shown diagrammatically in FIG. 1 for the purpose of explaining the overall construction of the electronic timepiece.

The insulating carrier 20 can be a ceramic or glass disc on which a group of five outer rings is applied using a convenient technology as for example printed circuit technology, screen printing technology, thin film circuit technology or the like, the five rings being denoted by reference numeral 21. Connected with these rings in the clockwise direction and from the inside to the outside are five ring connections 22, 23, 24, 25, and 26 which are subsequently connected for one respective electrode of the time marks for the minutes display. Within this ring-shaped arrangement of connections 22 to 26 and, respectively, the following connections which are not provided with reference numerals there is a further ring of connections for the time marks of the hours display. The hour time marks are denoted 27, 28, 29, and 30 on a selected group of four connections. Each connection corresponds to the display of one quarter hour between the subsequently following numbers of a timepiece face provided with numbers. The connections 27 to 30 etc. lie on an inner group of four rings 31. Connections are arranged, for example in a square formation, around the free space 32, which serve for the connection of the integrated circuit, made up of the oscillator, dividers, counters, and decoders, which are shown in detail in FIG. 1. For the sake of simplicity only the connections in accordance with the connections A1 to A5, A'1 to A'4, K1 to K12 and K'1 to K'12 at the decoders are shown in FIG. 2.

Furthermore, the battery connections + and − are indicated together with two connections 33, between which the quartz element with the setting capacitor is coupled. There also is shown two connections 35 and 36 for setting the hours and minutes respectively of the timepiece.

The integrated circuit lines pass to the rings and, respectively, to the ring sections. The latter are in the case of the embodiment shown reduced in size to punctuate connections. The ring sections provided for the minute display are denoted for example by reference numeral 37. The ring sections provided for the hours are denoted at 38. At the connections 39 there is connected for example an LED for the second strokes, which does not indicate the seconds and instead only shines in accordance with the second strokes and simultaneously serves to indicate in a visible manner that the timepiece is functioning. Connected with the connections for −, + the quartz connection 33 and the connections 35 and 36; soldering support points 39 and 44 are provided, which are connected with the parts, not mounted on the insulating carrier, of the timepiece, including for example the battery.

The FIGS. 3*a* and 3*b* represent the top and bottom sides of LED blocks 50, which respectively form one group of time marks. The latter are mounted with the strip-shaped metallized zones 22*a*, 23*a*, 24*a*, 25*a*, and 26*a* on the corresponding connections 22, 23, 24, 25, and 26 and connected in a conducting manner. On the top side of these blocks 50 directly over the fully metallised zones there are grid-like metallised zones 22*b*, 23*b*, 24*b*, 25*b*, and 26*b*, which form the cathode of the LED' at which the photo-effect representing the time mark is to appear. The cathode is connected via the connection 51 with one of the connection points 37. The LED blocks 52 for the representation of the time light marks for hours are similarly constructed, though however only four light marks per hour are provided. The blocks have their lower side reproduced in FIG. 4*b* lying on the inner row of connections 27 to 30 et seq. and are connected with their cathode in accordance with FIG. 4*a* via the connection 53 at the ring sections 38 which are reduced to points.

FIG. 5 represents the upper side of a timepiece dial constructed as a liquid crystal cell. In this respect the electrodes for activation of the zones of the liquid crystal cell are reproduced by line-like structures, the electrodes being constructed in a transparent manner using, for example tin oxide. The outer row 61 which is reproduced only in part, represents the display for the minutes while the inner row 62 represents the display for the hours. In this respect the time marks for the minute display are connected together in groups of five and arranged respectively on a contact surface 63 corresponding to the ring sections. In a similar manner in the hour display one respective group of four time marks is arranged on one contact surface 64, which corresponds to the other group of ring sections. As seen in FIG. 6, the separate time marks can be connected together to form ring segments, which again must also be transparent.

FIG. 7 shows part of the lower side of the liquid crystal cell, in the case of which the time marks are substantially opaque. In this respect two time marks of each group can be connected with suitable connecting tracks on the liquid crystal cell, as is indicated for example in the case of the marks 61*a* and the ring 66 and, respectively, in the case of the mark 61*b* and the ring 65.

FIG. 8 shows an insulating carrier, on which on the one side the conductor tracks or paths provided for connection of the integrated circuit are arranged while on the other side the time marks 61 and 62 are printed, once again as conducting tracks or paths. The time marks 61*a* and 61*b* are only printed once for conducting current, since they are already connected on the liquid crystal cell with the conductor tracks connected with them. Circular tracks of a suitable form are associated with the time marks 61*c* to 61*e*, and once again an overlap at 67 is to be provided by an additional operation with insulation of the underlying conductor tracks applied. The individual conductor tracks or paths are led to the soldering support points 71, 72, 73, 74, and 75. In the case of the time marks 61 for indicating seconds the corresponding soldering support points are displaced inwards and they are denoted by reference numerals 81, 82, 83, and 84.

The making of contact at the surface of the liquid crystal cell is carried out by means of an element as shown in FIG. 9 which consists of an insulating carrier, on which in the same surface arrangement as on the surface of the liquid crystal cell in accordance with FIG. 5 contact surfaces similar to those at 63 and 64 in accordance with FIG. 5 are provided which are denoted by 63*a* and 64*a*. They are also connected with a soldering support point 90 and 91, respectively. The conducting connection is produced via a ring 100, represented in FIG. 10, of rubber which becomes conducting under pressure. Ring 100 connects the contact surfaces 90 and 91 with the contact surfaces 63 and 64 and owing to the property of this ring 100 no contact is present between the contact surfaces 91 and 90. The inwardly following ring 101 connects the minute time marks of the lower side (FIG. 7) of the liquid crystal cell with the conductor tracks, printed on the insulating carrier (FIG. 8) in accordance with the time marks 61, 62 and between the individual marks no electric contact is present. The same applies for the hour time marks 62 on the lower side of the liquid crystal cell, which are so connected with the corresponding markings 62 on the insulating carrier 8 by the ring 102 that between the time marks no electric contact is made.

In FIG. 11 a plan view of a timepiece dial is represented diagrammatically. FIG. 11 shows how the timepiece indicates the time on actuating a switch in the case of the use of an LED display with a timepiece dial which is decorated. The dial is denoted by reference numeral 110 and carries over its periphery marks 111, which if required, can be supplemented by luminous marks 112. A mark 113 indicates the center of the dial 100. At this position the seconds beat device indicating the second pulses can be caused to appear on actuating the switch. Reference numeral 114 indicates the minute display while reference numeral 115 indicates the hours display.

What I claim is:

1. An electronic timepiece comprising a display, and having an oscillator with output signals employed as a time base, a frequency divider coupled to said oscillator to divide the frequency of the oscillator output signals to the desired clock frequency to provide clock pulses, counting means coupled to said frequency divider for counting the clock pulses, and decoding circuits coupled to said counting means for applying clock pulses to said display such that time marks corresponding to the clock pulse frequency are displayed, said display comprising time marks and an insulating carrier on which there is disposed sets of electrodes coupled to said decoding circuits, said electrodes connected together in a matrix-like arrangement including lines and columns, in which one set of electrodes for said time marks are applied to the lines of said matrix-like arrangement and the other set of electrodes for said time marks are applied to the columns of the matrix-like arrangement and the product of the number of lines and the number of columns is equal to the number of said time marks employed and on driving the lines and the columns of this matrix-like arrangement only one respective time mark responds, wherein the lines of the matrix-like arrangement are constructed as concentric rings and the columns of the matrix-like arrangement are constructed as ring sections concentric to said rings and said time marks are selectively coupled between said rings and said ring sections to be actuated thereby and provide a time display.

2. An electronic timepiece as defined in claim 1 wherein said electrodes printed on said insulating carrier are covered with an insulating layer including access openings to said rings at the corresponding positions for the connection of said rings and said time marks and to said ring sections and further including conducting tracks printed on said insulating layer for coupling said rings with the corresponding connections for said time marks.

3. An electronic timepiece as defined in claim 2 wherein the connections associated with an adjacent ring, for a time mark is directly connected to said ring.

4. An electronic timepiece as defined in claim 1 wherein on said insulating carrier in the exposed central part of said ring and ring sections are connected with the corresponding rings and ring sections and serve for the connection of an integrated circuit comprising the oscillator, the divider stages, the counters and the decoding means.

5. An electronic timepiece as defined in claim 1 wherein said time marks are LED'S whose anodes are connected with the corresponding rings and whose cathodes are connected with the corresponding ring sections.

6. An electronic timepiece as defined in claim 1 wherein said display means comprises a liquid crystal cell defining a timepiece dial wherein one surface on the observer side of said cell carries transparent electrodes corresponding to the arrangement of the time marks which are connected with the ring sections while the surface of said cell remote from the observer is provided with substantially opaque electrodes at the positions of the time marks.

7. An electronic timepiece as defined in claim 5 and further including a cover plate constructed like a timepiece dial and made of opaque material, and areas corresponding to said time marks which are at least translucent, said plate positioned to cover said insulating carrier.

8. An electronic timepiece comprising a display, and having an oscillator with output signals employed as a time base, a frequency divider coupled to said oscillator to divide the frequency of the oscillator output signal, to the desired clock frequency to provide clock pulses, counting means coupled to said frequency divider for counting the clock pulses, and decoding circuits coupled to said counting means for applying clock pulses to said display such that time marks corresponding to the clock pulse frequency are displayed, said display comprising time marks and an insulating carrier on which there is disposed sets of electrodes coupled to said decoding circuits, said electrodes connected together in a matrix-like arrangement including lines and columns, in which one set of electrodes for said time marks are applied to the lines of said matrix-like arrangement and the other set of electrodes for said time marks are applied to the columns of the matrix-like arrangement and the product of the number of lines and the number of columns is equal to the number of said time marks employed and on driving the lines and the columns of this matrix-like arrangement only one respective time mark responds, wherein the lines of the matrix-like arrangement are constructed as concentric rings and the columns of the matrix-like arrangement are constructed as ring sections concentric to said rings and said time marks are selectively coupled between said rings and said ring sections to be actuated thereby and provide a time display wherein said time marks are LED'S whose anodes are connected with the corresponding rings and whose cathodes are connected with the corresponding ring sections, and wherein LED'S comprise a block of LED material which extends over a number of time marks corresponding to the number of rings and the block is metallized in sections on a surface mounted on said insulating carrier and at these sections soldered to form the connections and on the opposite side of said block includes a grid-like metallization, said metallization connected to said ring section.

9. An electronic timepiece as defined in claim 8 wherein said grid-like metallizations of said time marks and the associated metallizations on said opposite side of said block are directed towards the center of the circular arrangement.

10. An electronic timepiece as defined in claim 8 wherein conducting tracks are arranged over windows in said insulating layer to provide a conducting connection between said block and said ring sections.

11. An electronic timepiece as defined in claim 8 wherein said oscillator, said frequency divider, said counting means and said decoding circuit, comprise an integrated circuit and wherein said block is connected directly to the corresponding connections of said integrated circuit.

12. An electronic timepiece comprising a display, and having an oscillator with output signals employed as a time base, a frequency divider coupled to said oscillator to divide the frequency of the oscillator output signal, to the desired clock frequency to provide clock pulses, counting means coupled to said frequency divider for counting the clock pulses, and decoding circuits coupled to said counting means for applying clock pulses to said display such that time marks corresponding to the clock pulse frequency are displayed, said display comprising time marks and an insulating carrier on which there is disposed sets of electrodes coupled to said decoding circuits, said electrodes connected together in a matrix-like arrangement including lines and columns, in which one set of electrodes for said time marks are applied to the lines of said matrix-like arrangement and the other set of electrodes for said time marks are applied to the columns of the matrix-like arrangement and the product of the number of lines and the number of columns is equal to the number of said time marks employed and on driving the lines and the columns of this matrix-like arrangement only one respective time mark responds, wherein the lines of the matrix-like arrangement are constructed as concentric rings and the columns of the matrix-like arrangement are constructed as ring sections concentric to said rings and said time marks are selectively coupled between said rings and said ring sections to be actuated thereby and provide a time display wherein said display means comprises a liquid crystal cell defining a timepiece dial wherein one surface on the observer side of said cell carries transparent electrodes corresponding to the arrangement of the time marks which are connected with the ring sections, while the surface of said cell remote from the observer is provided with substantially opaque electrodes at the positions of the time marks, and wherein said liquid crystal cell is coupled to said electrodes by rings of rubber becoming conducting under pressure.

* * * * *

UNITED STATES PATENT AND TRADEMARK OFFICE

CERTIFICATE OF CORRECTION

PATENT NO. : 4,095,413

DATED : June 20, 1978

INVENTOR(S) : Joachim Reich

It is certified that error appears in the above-identified patent and that said Letters Patent are hereby corrected as shown below:

Abstract; line 8:
"The one set" should be --One set--

Abstract; line 14:
After "lines" insert --of the matrix-like arrangement--

Abstract; lines 15 and 16:
Delete "of the matrix-like arrangement"

Column 1; line 25:
Delete "the" second occurrence

Column 1; line 67:
"intergrated" should be --integrated--

Column 2; line 26:
"blocks" should be --block--

Column 2; line 30:
"metallization" should be --metallizations--

Column 2; line 59:
"observeris" should be --observer is--

Column 2; lines 59 and 60:
"elecrodes" should be --electrodes--

UNITED STATES PATENT AND TRADEMARK OFFICE

CERTIFICATE OF CORRECTION

PATENT NO. : 4,095,413

DATED : June 20, 1978

INVENTOR(S) : Joachim Reich

It is certified that error appears in the above-identified patent and that said Letters Patent are hereby corrected as shown below:

Column 3; line 37:
"stabitizes" should be --stabilizes--

Column 3; line 56:
"K1 and K4" should be --K1 to K4--

Column 3; line 58:
"K5 and K12" should be --K5 to K12--

Column 5; line 30:
"metallised" should be --metallized--

Column 5; line 31:
"metallised" should be --metallized--

Column 5; line 32:
"LED'" should be --LED'S--

Column 6; line 42:
After "102" insert --so--

Signed and Sealed this

*First* Day of *May 1979*

[SEAL]

*Attest:*

RUTH C. MASON
*Attesting Officer*

DONALD W. BANNER
*Commissioner of Patents and Trademarks*